US011035391B2

(12) United States Patent
Wellenberg et al.

(10) Patent No.: US 11,035,391 B2
(45) Date of Patent: Jun. 15, 2021

(54) HYDROSTATIC LINEAR DRIVE SYSTEM

(71) Applicant: Kautex Maschinenbau GmbH, Bonn (DE)

(72) Inventors: Arndt Wellenberg, Hennef (DE); Minka Tschekorsky Orloff, Bonn (DE)

(73) Assignee: KAUTEX MASCHINENBAU GMBH, Bonn (DE)

( * ) Notice: Subject to any disclaimer, the term of this patent is extended or adjusted under 35 U.S.C. 154(b) by 0 days.

(21) Appl. No.: 16/857,938

(22) Filed: Apr. 24, 2020

(65) Prior Publication Data

US 2020/0340503 A1 Oct. 29, 2020

(30) Foreign Application Priority Data

Apr. 26, 2019 (DE) ..... 10 2019 110 917.5

(51) Int. Cl.
*F15B 1/02* (2006.01)
*F15B 15/18* (2006.01)
*F15B 15/14* (2006.01)

(52) U.S. Cl.
CPC ..... *F15B 15/18* (2013.01); *F15B 1/021* (2013.01); *F15B 15/149* (2013.01)

(58) Field of Classification Search
CPC ..... F15B 11/036; F15B 11/022; F15B 1/021; F15B 2211/775
See application file for complete search history.

(56) References Cited

U.S. PATENT DOCUMENTS 5,852,933 A * 12/1998 Schmidt ..... F15B 3/00 60/413

FOREIGN PATENT DOCUMENTS

DE 102010051140 A1 5/2012
JP 4614544 B2 7/2002

OTHER PUBLICATIONS

Machine Translation of DE102010051140 provided by Espacenet.*

* cited by examiner

*Primary Examiner* — Abiy Teka
*Assistant Examiner* — Daniel S Collins
(74) *Attorney, Agent, or Firm* — Lucas & Mercanti, LLP

(57) ABSTRACT

A linear drive system, in particular for a closure unit of a blow mold installation, with a simpler and more compact structure, a higher retraction and expansion speed in rapid mode, higher forces in power mode, and reduced energy consumption, than the prior art includes a cylinder arrangement which brings about a retraction and extension movement in rapid mode by separate hydraulically active faces which are independent of a larger hydraulically active face which is acted on with pressurized hydraulic fluid only in power mode. During the extension movement in power mode, however, the hydraulically active faces cooperate which contributes to high forces with a compact structure of the drive system.

20 Claims, 12 Drawing Sheets

HYDROSTATIC LINEAR DRIVE SYSTEM

CROSS-REFERENCE TO RELATED APPLICATIONS

The present invention claims priority to DE 10 2019 110 917.5, filed Apr. 26, 2019, the entire contents of which are incorporated herein by reference.

FIELD OF THE INVENTION

The invention relates to a hydrostatic linear drive system, in particular for a closure unit of a blow mold installation

BACKGROUND OF THE INVENTION

Hydrostatic linear drive systems are used, for example, in hydraulic presses, deep-drawing or injection-molding machines. Such machines generally have a plurality of movement sequences. One of these movement sequences is a power mode in which a high force is applied at low speed to a workpiece which is intended to be processed or a component which is intended to be moved. Another of these movement sequences is a rapid mode in which a smaller force is applied but enables a more rapid movement.

Such a linear drive system is known, for example, from DE 10 2016 113 882 A1. The known linear drive system has a hydraulic pump which is driven by an electric motor and which can be reversed in terms of flow direction. The hydraulic pump provides a changeable volume flow of a hydraulic fluid in a closed hydraulic circuit which comprises a first differential cylinder as a main cylinder. The annular piston face at the rod side of the differential cylinder is smaller than the piston face at the piston side. The closed hydraulic circuit is closed with respect to the environment thereof and has during operation an excess pressure with respect to the environment. This excess pressure is produced in a manner known per se by a pretensioning source. In order to compensate for the different volumes of the differential cylinder when it is moved in the retraction and extension direction, the drive system requires an equalizing tank. The equalizing tank is preferably constructed as a second differential cylinder whose cylinder chamber is open with respect to the environment at the piston side and whose annular face corresponds to the difference between the piston face and the annular face of the main cylinder. The piston rods of the two differential cylinders are mechanically coupled. A 2/2-way valve is arranged in the connection line between the annular space of the second cylinder which functions as an equalizing tank and the annular space of the main cylinder. In another connection line between the annular space of the second cylinder which functions as an equalizing tank and the piston chamber of the main cylinder, another 2/2-way valve is arranged. In order to retract and extend the main cylinder in the power mode, the 2/2-way valve is opened between the two annular spaces of the two differential cylinders, whilst the additional 2/2-way valve is blocked. In order to retract and extend the main cylinder in the rapid mode, the 2/2-way valve is in the meantime blocked between the two annular spaces of the differential cylinders, whilst the additional 2/2-way valve is opened.

The equalizing tank which is constructed as a differential cylinder results in the extension and retraction movement of the main cylinder in rapid mode always being carried out counter to the resistance of the second cylinder which functions as an equalizing tank, whereby high displacement speeds in rapid mode with at the same time significant forces in the power mode cannot be produced. For the operation of the drive system in rapid or in power mode, two 2/2-way valves are in addition absolutely necessary.

JP 46 14 544 B2 discloses a hydrostatic linear drive system having a 3-face cylinder, wherein a hydraulically active face for a power mode and two hydraulically active faces for a rapid mode are provided. The retraction and extension of the 3-face cylinder in rapid mode is carried out by the two hydraulically active faces for the rapid mode, which can be selectively acted on by a closed hydraulic circuit comprising a hydraulic pump. The cylinder chamber which is associated with the hydraulically active face for the power mode, when extended in rapid mode, is filled with fluid by a pretensioned equalizing tank. In power mode, this cylinder chamber is connected in a fluid-conducting manner to a pump which is connected at the intake side to a tank and the pretensioned equalizing tank. At the same time, the pressure of the pretensioned equalizing tank acts counter to the extension direction on one of the two hydraulically active faces for the rapid mode.

DE 10 2010 051 140 A1 discloses a linear drive system for a drawing press having a pressing frame, in which a tappet carrying an upper tool and a drawing cushion are supported with a drawing cushion plate on which a workpiece holding-down member is supported. The drawing cushion plate is mechanically coupled to the tappet by a strut arrangement. Rapid mode cylinders are provided for accelerated activation of the tool holding-down member and for the hydraulically driven upward and downward movement thereof. Furthermore, clamping cylinders which are supported on the drawing cushion plate and which are constructed as plungers are provided; they serve to move and act with force on the workpiece holding-down member relative to the drawing cushion plate. The pistons of the clamping cylinders and the rapid mode cylinders are coupled. For the pre-acceleration operation, there is provision shortly before the upper tool is placed on the holding-down members for the rapid mode cylinders to pre-accelerate the holding-down members and the pistons of the clamping cylinders in the movement direction of the tappet. The clamping cylinder chambers are in this instance connected by non-return valves to a pretensioned low-pressure store.

BRIEF SUMMARY OF THE INVENTION

An object of the invention is to provide a linear drive system which has a simpler and more compact construction than the prior art, with at the same time higher retraction and extension speed in rapid mode, higher forces in power mode, and reduced energy consumption.

The object is met based on the notion of bringing about the retraction and extension movement in rapid mode by separate hydraulically active faces, which are independent of a larger hydraulically active face which is acted on with pressurized hydraulic fluid only in power mode. The mechanical and hydraulic resistances are reduced by the larger hydraulically active face in rapid mode not functioning counter to a pressurized hydraulic fluid, but instead by the hydraulic fluid which is intended to be displaced from the cylinder chamber being supplied to an equalizing tank which is open with respect to the environment, that is to say, is not pretensioned, or by the hydraulic fluid which is intended to be supplied to the cylinder chamber being drawn from the equalizing tank. During the extension movement in power mode, however, the hydraulically active faces cooperate with each other which contributes to high forces with a compact structure of the drive system.

In a first embodiment according to the invention, the retraction and extension of the cylinders in the rapid mode is produced exclusively by synchronous cylinders which are incorporated in the closed hydraulic circuit. In rapid mode, hydraulic fluid is prevented from acting on the first hydraulically active face of the single-action cylinder.

The extension of the cylinders in power mode is produced first and foremost by the single-action cylinder whose first hydraulically active face is acted on with the hydraulic fluid in the extension direction. However, the single-action cylinder is supported during extension by the synchronous cylinder whose second hydraulically active face is also acted on with hydraulic fluid in the extension direction. In this embodiment, the mechanical coupling between the single-action cylinder and the synchronous cylinder is carried out by a coupling member between the piston rods of the two cylinders.

Another reduction of the mechanical resistances and the energy consumption is achieved by the single-action cylinder being a plunger cylinder, also referred to as a plunger piston cylinder. The piston rod of the plunger cylinder acts at the same time as a piston. Plunger cylinders have a better degree of mechanical efficiency than conventional, single-action cylinders.

A second embodiment of the present invention relates to a linear drive system having a cylinder—also referred to below as a 3-face cylinder—which integrates the hydraulically active faces of the single-action cylinder and the synchronous cylinder of the first embodiment in one component and which thereby contributes to a particularly compact construction type.

The retraction and extension of the 3-face-cylinder in rapid mode, as in the first embodiment, is brought about exclusively by acting on the second or third hydraulically active face with hydraulic fluid. In rapid mode, acting on the larger first hydraulically active face is prevented.

The extension of the 3-face cylinder in power mode is brought about first and foremost by acting on the larger, first hydraulically active face with hydraulic fluid. As in the first embodiment, however, the extension is supported by acting on the second hydraulically active face in the extension direction.

The low-pressure connection of the second hydraulic pump is connected in a fluid-conducting manner to the equalizing tank and the high-pressure connection is connected in a fluid-conducting manner to the first fluid connection of the single-action cylinder in the first embodiment or to the first fluid connection of the 3-face cylinder according to the second embodiment.

The fluid-conducting connection between the high-pressure connection of the second hydraulic pump and the first fluid connection can be carried out directly or indirectly.

In the case of a direct fluid-conducting connection, in rapid mode of the linear drive system, action on the first hydraulically active face simply by deactivation of the second hydraulic pump can be prevented. A blocking member is not required in this preferred embodiment since the high-pressure connection of the second hydraulic pump is exclusively connected in a fluid-conducting manner to the first fluid connection of the single-action cylinder or the 3-face cylinder. This embodiment therefore contributes to the simple and compact structure of the linear drive system.

In the case of an indirect fluid-conducting connection, the high-pressure connection of the second hydraulic pump is connected in a fluid-conducting manner to the first fluid connection indirectly via the second pressure connection of the first hydraulic pump. In such an embodiment of the invention, a non-return valve is arranged in the fluid-conducting connection between the second and first hydraulic pump such that a return flow of the hydraulic fluid in the direction of the second hydraulic pump is prevented. A fluid-conducting connection to a second shut-off member is provided between the first pressure connection of the first hydraulic pump and the first fluid connection. In rapid mode of the linear drive system acting on the first hydraulically active face is prevented using the shut-off member. In the power mode of the linear drive system, the first hydraulically active face is acted on with hydraulic fluid by the open shut-off member.

In the embodiment having the indirect fluid-conducting connection, the second hydraulic pump may be configured to be weaker than the first hydraulic pump since in principle it only has to provide the additional volume of hydraulic fluid, whilst the pressure build-up is carried out mainly via the first hydraulic pump. Of course, however, a second hydraulic pump with correspondingly greater dimensions may also contribute mainly to the pressure build-up in power mode. In addition, the second hydraulic pump in this embodiment may compensate for leakage oil in the closed hydraulic circuit and may pretension the closed hydraulic circuit.

In order to control the speed and force of the linear drive system in the power or rapid mode, the first and/or second hydraulic pump provides in an advantageous embodiment of the invention a changeable volume flow of the hydraulic fluid. To this end, the displacement volume and/or the drive speed of the first and/or second hydraulic pump may be changeable.

The driving of the hydraulic pump is carried out, for example, by an electric motor, whose speed and rotation direction can be changed in order to change the volume flow and the flow direction. If the driving is carried out by a speed-constant electric motor, the displacement volume of the hydraulic pump can be variable in order to change the volume flow. The displacement volume with a variable displacement pump, for example, is steplessly changed by adjusting a swash plate. When the swash plate is changed through the zero position, the flow direction of the volume flow changes so that the flow direction is reversed and the high-pressure and low-pressure side of the variable-displacement pump change over. Particularly energy-saving operation with an optimized overall degree of efficiency is preferably achieved with a combination of changeable speed of the electric motor and changeable displacement volume of the variable displacement pump.

In an advantageous embodiment of the invention, the pressure connections of the first and/or second hydraulic pump are connected to a pressure store. The connection to the connections is carried out by non-return valves which prevent a return flow from the pressure connections in the direction of the pressure store. The non-return valves open when there is a lower pressure at the pressure connections than in the pressure container. As a result of the pressure store, therefore, the dynamics of the linear drive system can be improved and/or energy can be saved.

If the pressure connections of the first hydraulic pump are connected to a pressure store, it can act at the same time as a pretensioning source for the closed hydraulic circuit. The pretensioning is, however, produced first and foremost by a hydraulic pump.

The pretensioning pressure in the closed hydraulic circuit is higher than ambient pressure. Ambient pressure is the hydrostatic pressure of the air which is applied at the location of the installation of the linear drive system. The mean air pressure of the atmosphere (atmospheric pressure) is normally approximately 1 bar. The pretensioning pressure is 5 to 50 bar, preferably between 10 and 25 bar.

The shut-off members provided in the hydraulic lines serve to block or release the volume flow of the hydraulic fluid. The shut-off members are preferably non-return valves, in particular 2/2-way valves. The 2/2-way valve has two connections and two switch positions. In the first, closed switch position, the throughflow is blocked by the 2/2-way valve, in the second, open switch position, the throughflow is released by the 2/2-way valve.

In order to prevent damage to the equalizing tank in the decompression phase of the single-action cylinder, a throttle is arranged in the fluid-conducting connection between the equalizing tank and the first fluid connection on the single-action cylinder or the 3-face cylinder according to an another embodiment of the invention. As a result of the throttle, the pressure of the hydraulic fluid flowing through in the fluid-conducting connection is reduced. The throttle may be constructed as an integral component of the non-return valve.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
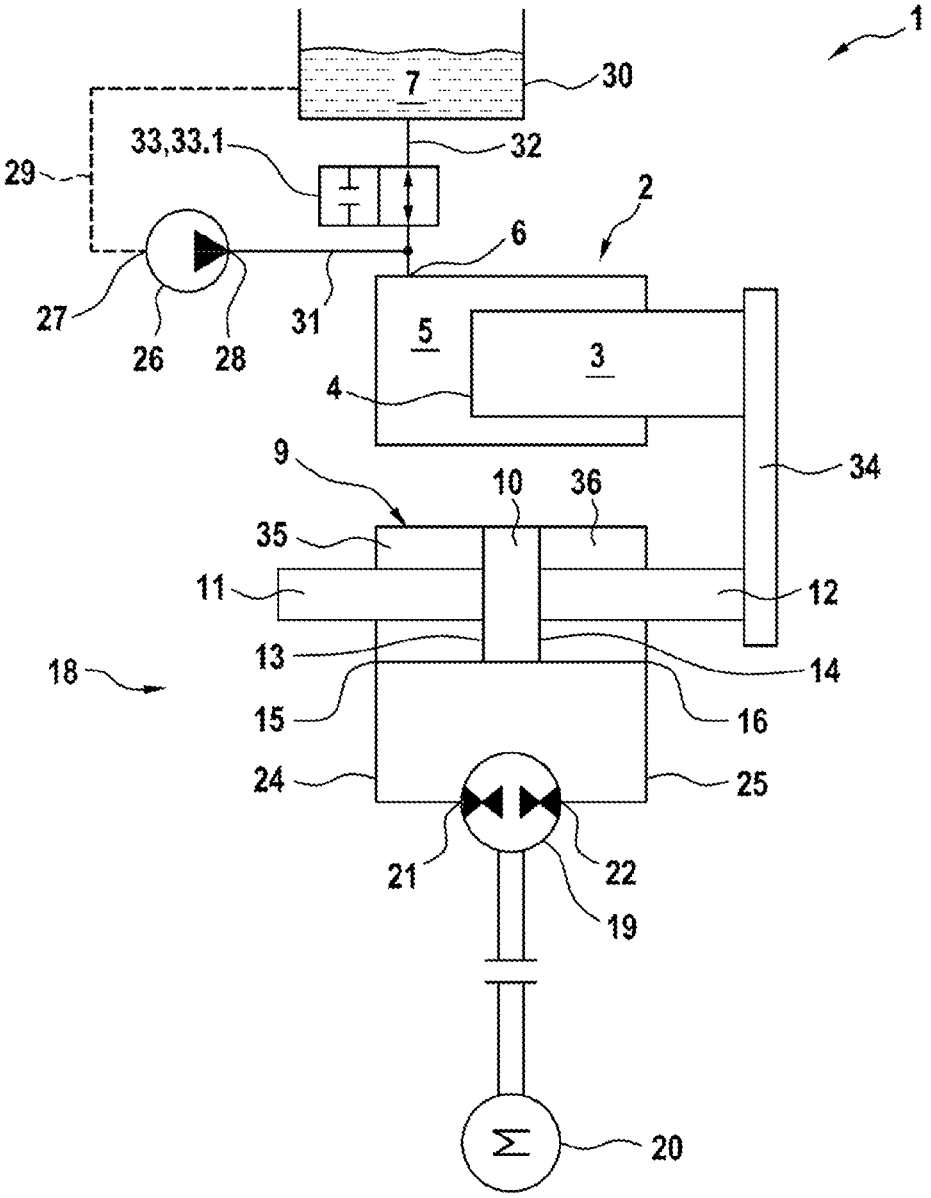
FIG. 1 is a schematic diagram of a first embodiment of the hydrostatic linear drive system having a single-action cylinder and a synchronous cylinder.

FIG. 1 shows a first embodiment of a hydrostatic linear drive system 1 having a single-action cylinder 2 which is constructed as a plunger cylinder. The plunger cylinder comprises a piston rod 3, a first hydraulically active face 4 and a first cylinder chamber 5 having a first fluid connection 6 for a hydraulic fluid 7. As a result of the construction of the single-action cylinder 2 as a plunger cylinder, the piston rod 3 is at the same time the piston. The end side of the piston rod 3 facing the cylinder chamber 5 is the piston face and is hydraulically active.

Figure 1B:
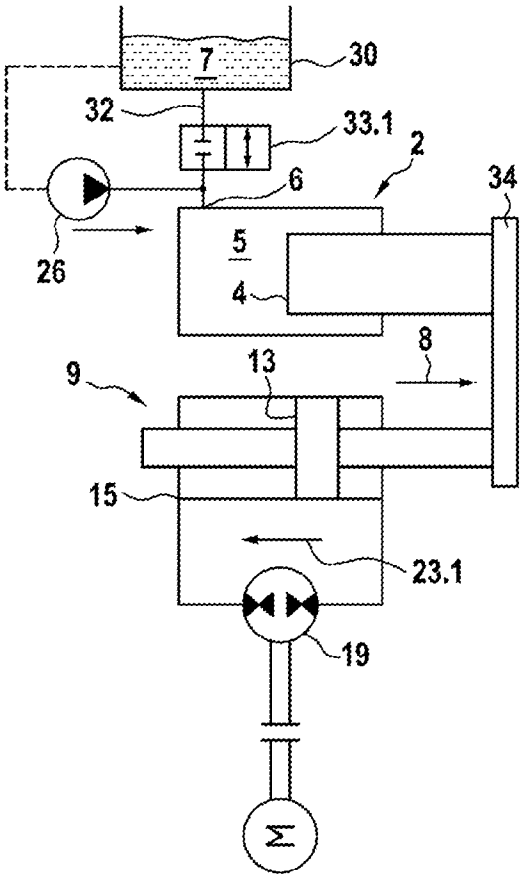
FIG. 1B is a schematic diagram of the first embodiment during an extension in a power mode.
Figure 1A:
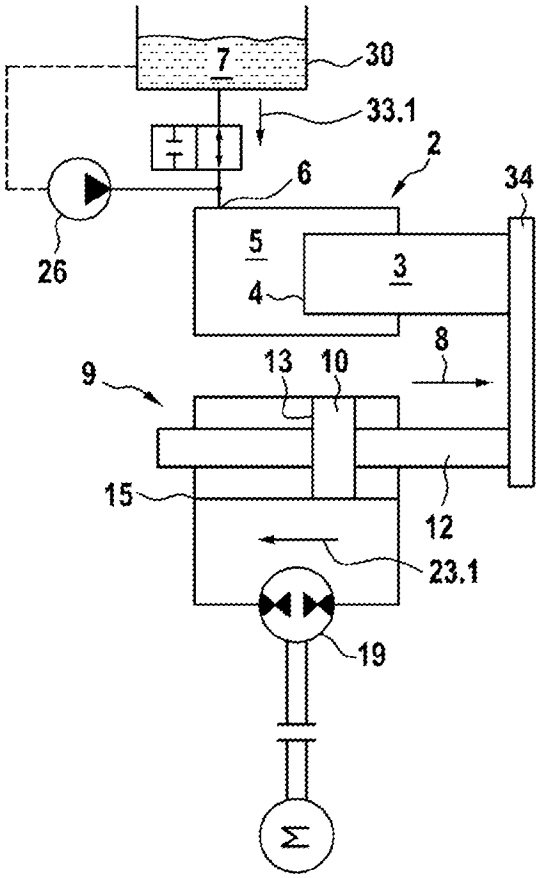
FIG. 1A is a schematic diagram of the first embodiment during an extension in a rapid mode.

The first hydraulically active face 4 of the single-action cylinder 2 can be acted on with the hydraulic fluid 7 via the first fluid connection 6 in an extension direction 8 (see FIG. 1A).

Referring back to FIG. 1, the linear drive system 1 further has a synchronous cylinder 9 which has at both sides of the piston 10 a piston rod 11, 12. The annular piston faces which surround the piston rods 11, 12 form a second hydraulically active face 13 and a third hydraulically active face 14 which correspond in terms of size/area. The synchronous cylinder 9 has a second fluid connection 15 and a third fluid connection 16, wherein the second fluid connection 15 opens in an annular second cylinder chamber 35 at the left side of the piston 10 and the third fluid connection 16 opens in an annular third cylinder chamber 36 at the right side of the piston 10.

The second hydraulically active face 13 can be acted on with hydraulic fluid 7 via the second fluid connection 15 in the extension direction 8 (see FIG. 1A). The third hydraulically active face 14 can be acted on with hydraulic fluid 7 via the third fluid connection 16 in the retraction direction 17 (see FIG. 1D).

A closed hydraulic circuit 18 which is under pretensioning pressure comprises the synchronous cylinder 9 and a first hydraulic pump 19 with a first and a second pressure connection 21, 22. An electric motor 20 drives the first hydraulic pump 19 at a constant or variable motor speed. The first hydraulic pump 19 is preferably an axial piston variable-displacement pump of the swash plate construction type. As a result of the adjustment of a pivot angle the swash plate, the volume flow of the first hydraulic pump 19 can be changed in a stepless manner. When the swash plate is adjusted through the zero position, the flow direction 23.1, 23.2 (see FIGS. 1A, 1B, and 1D) of the volume flow changes. The adjustment of the pivot angle of the swash plate is carried out in this instance hydraulically by an actuating piston.

Depending on the flow direction 23.1/23.2, the first pressure connection 21 is the high-pressure side and the second pressure connection 22 is the low-pressure side of the first hydraulic pump 19, or vice versa.

The first pressure connection 21 is connected to the second fluid connection 15 and the second pressure connection 22 is connected to the third fluid connection 16 in a fluid-conducting manner by a hydraulic line 24, 25, respectively. The pretensioning of the hydraulic fluid in the closed hydraulic circuit 18 may, for example, be produced by a pressure source which is not illustrated and which is connected to the pressure connections 21, 22 (for example, feed oil pump). Since the pretensioning of a closed hydraulic circuit 18 is known to the person skilled in the art, an illustration of the components required for this has been omitted for the sake of clarity.

In order to act on the first hydraulically active face 4 of the single-action cylinder 2 with hydraulic fluid 7, a second hydraulic pump 26 is provided with a low-pressure connection 27 and a high-pressure connection 28. The low-pressure connection 27 is connected in a fluid-conducting manner via a hydraulic line 29 to an equalizing tank 30 and the high-pressure connection 28 is connected in a fluid-conducting manner via a hydraulic line 31 to the first fluid connection 6 of the single-action cylinder 2.

The equalizing tank 30 which is open towards the environment receives hydraulic fluid 7 and is further connected in a fluid-conducting manner to the first fluid connection 6 of the single-action cylinder 2 via a hydraulic line 32. A 2/2-way valve 33.1 is arranged as a first shut-off member 33 in the hydraulic line 32 between the equalizing tank 30 and the single-action cylinder 2.

Finally, the piston rod 3 of the single-action cylinder 2 and the piston rod 12 of the synchronous cylinder 9 are mechanically connected to each other by a coupling member 34 in such a manner that both cylinders move exclusively in a synchronous manner.

When the linear drive system 1 is extended in rapid mode as shown in FIG. 1A, the second hydraulically active face 13 is acted on with hydraulic fluid 7 through the second fluid connection 15 by the first hydraulic pump 19 operating in the flow direction 23.1, whereby the piston 10 of the synchronous cylinder 9 moves in the extension direction 8. The piston rod 3 of the single-action cylinder 2 which is connected to the piston rod 12 of the synchronous cylinder 9 by the coupling member 34 is also moved in the extension direction 8 without the hydraulically active face 4 thereof being acted on with hydraulic fluid 7. The hydraulic fluid 7 passes through the open 2/2-way valve 33.1 from the equalizing tank 30 via the first fluid connection 6 into the cylinder chamber 5 of the single-action cylinder 2 (extraction). The second hydraulic pump 26 which is also connected to the first fluid connection 6 is not active.

Figure 1D:
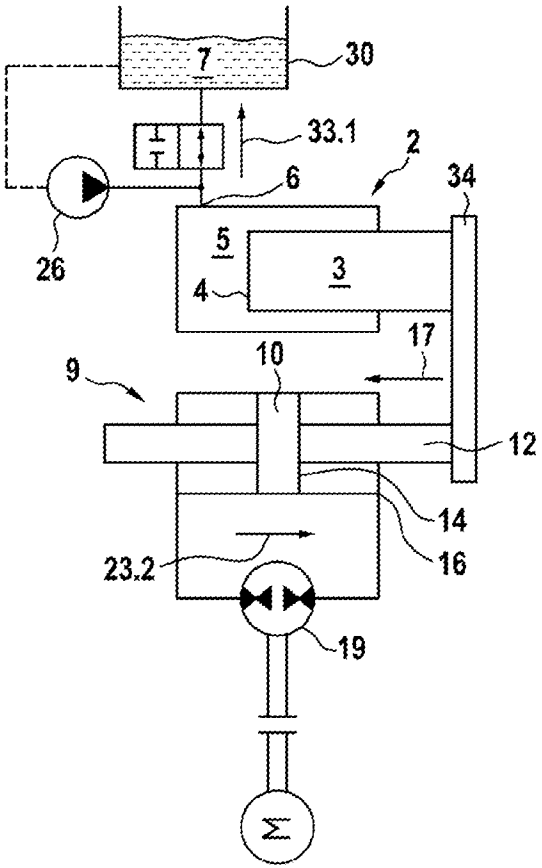
FIG. 1D is a schematic diagram of the first embodiment during a retraction in the rapid mode.

When the linear drive system 1 is retracted in rapid mode as shown in FIG. 1D, the third hydraulically active face 14 is acted on with hydraulic fluid 7 through the third fluid connection 16 by the first hydraulic pump 19 which is now operating in the opposite flow direction 23.2, whereby the piston 10 of the synchronous cylinder 9 moves in the retraction direction 17. The piston rod 3 of the single-action cylinder 2 which is connected to the piston rod 12 of the synchronous cylinder 9 via the coupling member 34 is also moved in the retraction direction 17 without the hydraulically active face 4 thereof being acted on with hydraulic fluid 7. The hydraulic fluid 7 is displaced through the open 2/2-way valve 33.1 from the cylinder chamber 5 of the single-action cylinder 2 into the equalizing tank 30. The second hydraulic pump 26 which is connected to the first fluid connection 6 is not active.

When the linear drive system 1 is extended in power mode as shown in FIG. 1B, the first hydraulically active face 4 of the single-action cylinder 2 is acted on with hydraulic fluid 7 through the first fluid connection 6 by the activated second hydraulic pump 26, whereby the single-action cylinder 2 moves in the extension direction 8. During extension in power mode, the first hydraulic pump 19 is further activated in the flow direction 23.1 so that through the second fluid connection 15 the second hydraulically active face 13 of the synchronous cylinder 9 is acted on with hydraulic fluid 7. The synchronous cylinder moves synchronously with the single-action cylinder 2, to which it is coupled via the coupling member 34, in the extension direction 8. A flow of the hydraulic fluid 7 via the hydraulic line 32 into the equalizing tank 30 is prevented by the closed 2/2-way valve 33.1. The force produced during extension in power mode is produced by the cooperation of the single-action cylinder 2 and the synchronous cylinder 9 which is acted on in the extension direction 8.

Figure 1C:
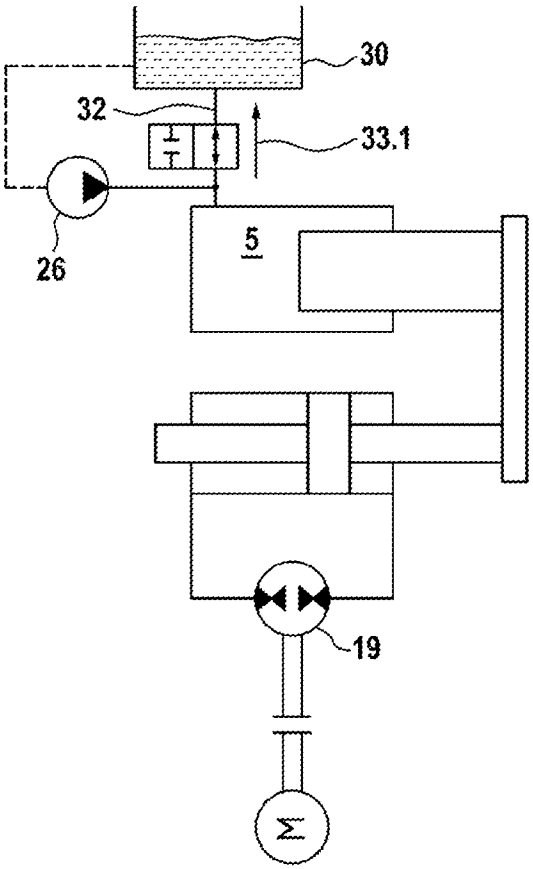
FIG. 1C is a schematic diagram of the first embodiment during cancellation of a force.

In order to end the power mode, the first hydraulic pump 19 and the second hydraulic pump 26 are deactivated and the 2/2-way valve 33.1 is opened so that the hydraulic fluid 7 can flow from the first cylinder chamber 5 via the open 2/2-way valve 33.1 in the hydraulic line 32 into the equalizing tank 30 as shown in FIG. 1C.

Figure 2:
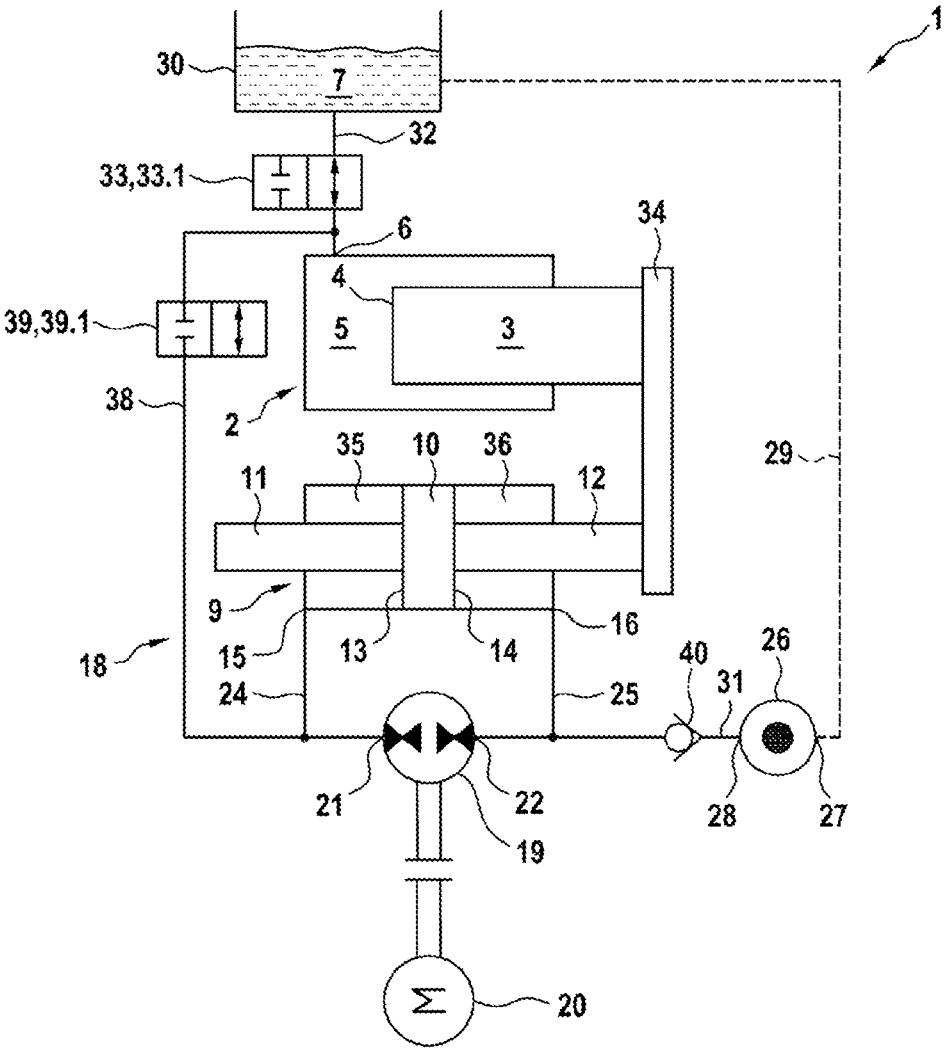
FIG. 2 is a schematic diagram of a second embodiment of the hydrostatic linear drive system with a single-action cylinder and a synchronous cylinder.

FIG. 2 shows a second embodiment of a hydrostatic linear drive system 1 having a single-action cylinder 2, which is constructed as a plunger cylinder. The plunger cylinder comprises a piston rod 3, a first hydraulically active face 4 and a first cylinder chamber 5 with a first fluid connection 6 for a hydraulic fluid 7. As a result of the construction of the single-action cylinder 2 as a plunger cylinder, the piston rod 3 is at the same time the piston. The end side of the piston rod 3 facing the cylinder chamber 5 is the first hydraulically active face 4.

The first hydraulically active face 4 of the single-action cylinder 2 can be acted on with the hydraulic fluid 7 in an extension direction 8 via the first fluid connection 6.

The linear drive system 1 further has a synchronous cylinder 9 which has at both sides of the piston 10 a piston rod 11, 12. The annular piston faces which surround the piston rods 11, 12 form a second hydraulically active face 13 and a third hydraulically active face 14 which correspond to each other in terms of size/area. The synchronous cylinder 9 has a second fluid connection 15 and a third fluid connection 16, wherein the second fluid connection 15 opens in an annular second cylinder chamber 35 at the left side of the piston 10 and the third fluid connection 16 opens in a third annular cylinder chamber 36 at the right side of the piston 10.

The second hydraulically active face 13 can be acted on in the extension direction 8 with hydraulic fluid 7 via the second fluid connection 15. The third hydraulically active face 14 can be acted on with hydraulic fluid 7 in the retraction direction 17 via the third fluid connection 16.

A closed hydraulic circuit 18 which is under a pretensioning pressure comprises the synchronous cylinder 9 and a first hydraulic pump 19 with a first and a second pressure connection 21, 22. An electric motor 20 drives the hydraulic pump 19 at a constant or variable motor speed. The hydraulic pump 19 is preferably an axial piston variable-displacement pump of the swash plate construction type as in the embodiment according to FIG. 1.

The first pressure connection 21 is connected to the second fluid connection 15 and the second pressure connection 22 is connected to the third fluid connection 16 in a fluid-conducting manner by a hydraulic line 24, 25, respectively. The pretensioning of the hydraulic fluid in the closed hydraulic circuit 18 may, for example, be produced by a pressure source which is not illustrated and which is connected to the pressure connections 21, 22.

In order to act on the first hydraulically active face 4 of the single-action cylinder 2 with hydraulic fluid 7, the first fluid connection 6 of the single-action cylinder 2 is connected by a hydraulic line 38 in a fluid-conducting manner to the first pressure connection 21 of the first hydraulic pump 19. A second shut-off member 39 which is constructed as a 2/2-way valve 39.1 is arranged in the hydraulic line 38. A high-pressure connection 28 of a second hydraulic pump 26 is connected in a fluid-conducting manner via a hydraulic line 31 to the second pressure connection 22 of the first hydraulic pump 19. A non-return valve 40 in the hydraulic line 31 prevents a return flow of the hydraulic fluid 7 in the direction of the second hydraulic pump 26.

A low-pressure connection 27 of the second hydraulic pump 26 is connected in a fluid-conducting manner by a hydraulic line 29 to the equalizing tank 30. In contrast to the embodiment according to FIG. 1, however, the high-pressure connection 28 of the second hydraulic pump 26 is not directly connected to the first fluid connection 6 of the single-action cylinder 2 in a fluid-conducting manner, but instead indirectly by the flow path released by the open 2/2-way valve 39.1 and the first hydraulic pump 19 which is activated in the flow direction 23.1.

The equalizing tank 30 which is open in the direction towards the environment receives hydraulic fluid 7 and is further connected in a fluid-conducting manner via a hydraulic line 32 to the first fluid connection 6 of the single-action cylinder 2. A 2/2-way valve 33.1 is arranged in the hydraulic line 32 between the equalizing tank 30 and the single-action cylinder 2 as a first shut-off member 33.

Finally, the piston rod 3 of the single-action cylinder 2 and the piston rod 12 of the synchronous cylinder 9 are mechanically connected to each other by a coupling member 34 in such a manner that both cylinders move exclusively in a synchronous manner.

Figure 2B:
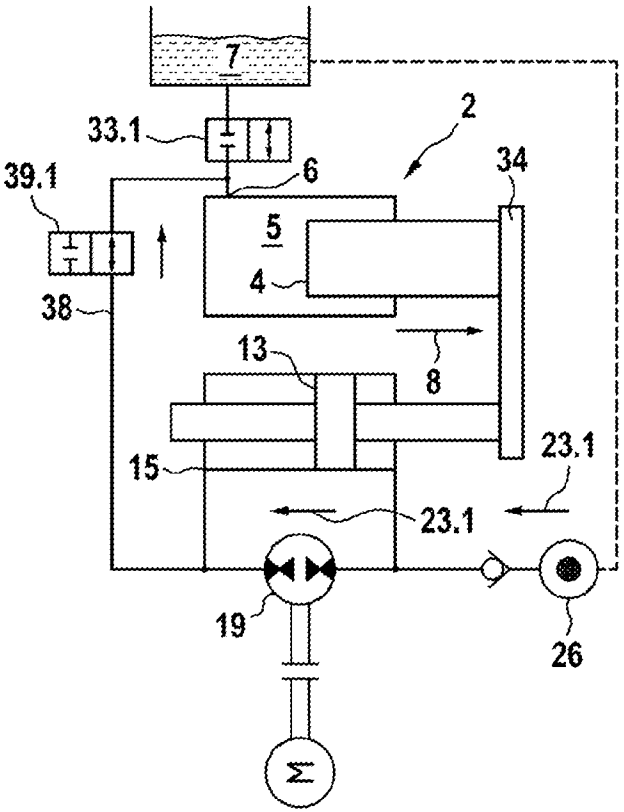
FIG. 2B is a schematic diagram of the second embodiment during an extension in a power mode.
Figure 2A:
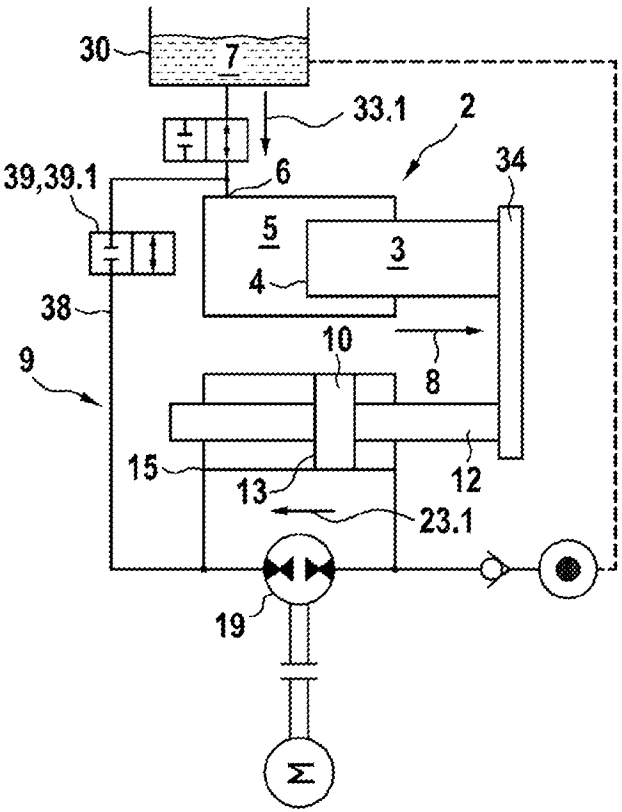
FIG. 2A is a schematic diagram of the second embodiment during an extension in a rapid mode.

When the linear drive system 1 is extended in the rapid mode, the second hydraulically active face 13 is acted on with hydraulic fluid 7 through the second fluid connection 15 by the first hydraulic pump 19 operating in the flow direction 23.1 as shown in FIG. 2A, whereby the piston 10 of the synchronous cylinder 9 moves in the extension direction 8. The piston rod 3 of the single-action cylinder 2 which is connected to the piston rod 12 of the synchronous cylinder 9 via the coupling member 34 is also moved in the extension direction 8 without the hydraulically active face 4 thereof being acted on with hydraulic fluid 7. The hydraulic fluid 7 from the equalizing tank 30 reaches the cylinder chamber 5 of the single-action cylinder 2 by the open 2/2-way valve 33.1 through the first fluid connection 6 (extraction). The first hydraulically active face 4 of the single-action cylinder 2 is not acted on since the 2/2-way valve 39.1 is closed in the hydraulic line 38.

Figure 2D:
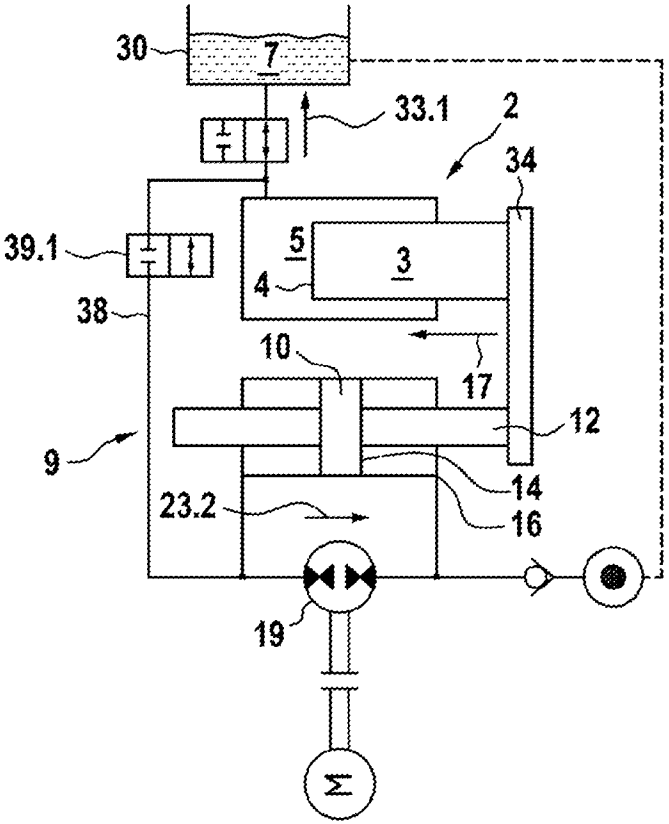
FIG. 2D is a schematic diagram of the second embodiment during the retraction in rapid mode.

When the linear drive system 1 is retracted in rapid mode, the third hydraulically active face 14 is acted on with hydraulic fluid 7 through the third fluid connection 16 by the first hydraulic pump 19 which is operated in the opposite flow direction 23.2 as shown in FIG. 2D, whereby the piston 10 of the synchronous cylinder 9 moves in the retraction direction 17. The piston rod 3 of the single-action cylinder 2, which is connected to the piston rod 12 of the synchronous cylinder 9 by the coupling member 34, is also moved in the retraction direction 17 without the hydraulically active face 4 being acted on with hydraulic fluid 7. The hydraulic fluid 7 is displaced through the open 2/2-way valve 33.1 from the cylinder chamber 5 of the single-action cylinder 2 into the equalizing tank 30. The 2/2-way valve 39.1 in the hydraulic line 38 is closed.

When the linear drive system 1 is extended in power mode, the first hydraulically active face 4 of the single-action cylinder 2 is acted on with hydraulic fluid 7 through the first fluid connection 6 as shown in FIG. 2B, whereby the single-action cylinder 2 moves in the extension direction 8. The 2/2-way valve 39.1 in the hydraulic line 38 is now open. Both the first hydraulic pump 19 and the second hydraulic pump 26 are activated and convey the hydraulic fluid 7 in a corresponding flow direction 23.1 in the direction of the first fluid connection 6 of the single-action cylinder 2. The activated second hydraulic pump 26 provides the required additional volume of hydraulic fluid 7 from the equalizing tank 30 in order to act with hydraulic fluid 7 on the first hydraulically active face 4 of the single-action cylinder 2 through the first fluid connection 6 and to act with hydraulic fluid 7 on the second hydraulically active face 13 of the synchronous cylinder 9 through the second fluid connection 15. The synchronous cylinder 9 moves synchronously in the extension direction 8 with the single-action cylinder 2, to which it is coupled via the coupling member 34. A flow of the hydraulic fluid 7 via the hydraulic line 32 into the equalizing tank 30 is prevented by the closed 2/2-way valve 33.1.

Figure 2C:
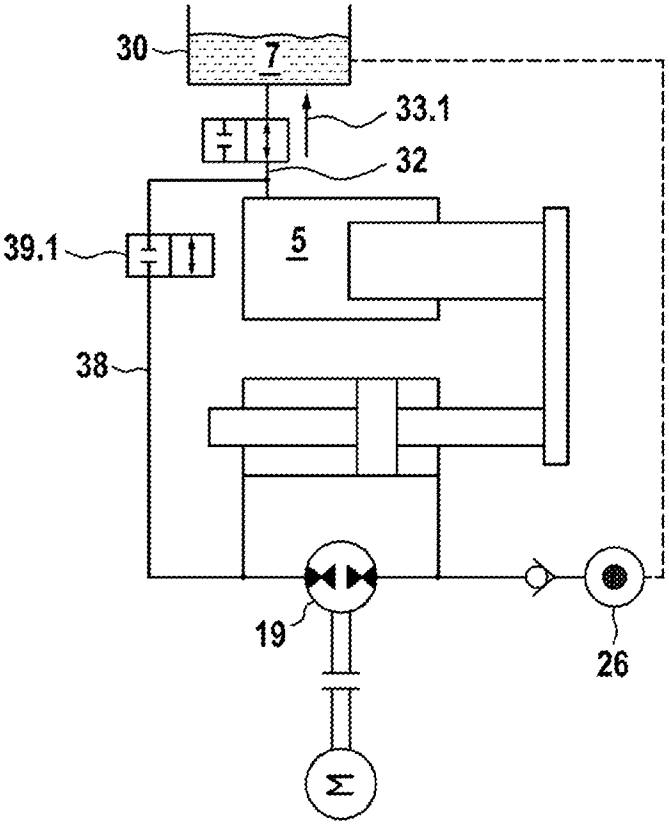
FIG. 2C is a schematic diagram of the second embodiment during cancellation of the force.

In order to end the power mode, the first hydraulic pump 19 and the second hydraulic pump 26 are deactivated, the 2/2-way valve 33.1 is opened, and the 2/2-way valve 39.1 in the hydraulic line 38 is closed as shown in FIG. 2C so that the hydraulic fluid 7 flows from the first cylinder chamber 5 via the open 2/2-way valve 33.1 in the hydraulic line 32 into the equalizing tank 30.

Figure 3:
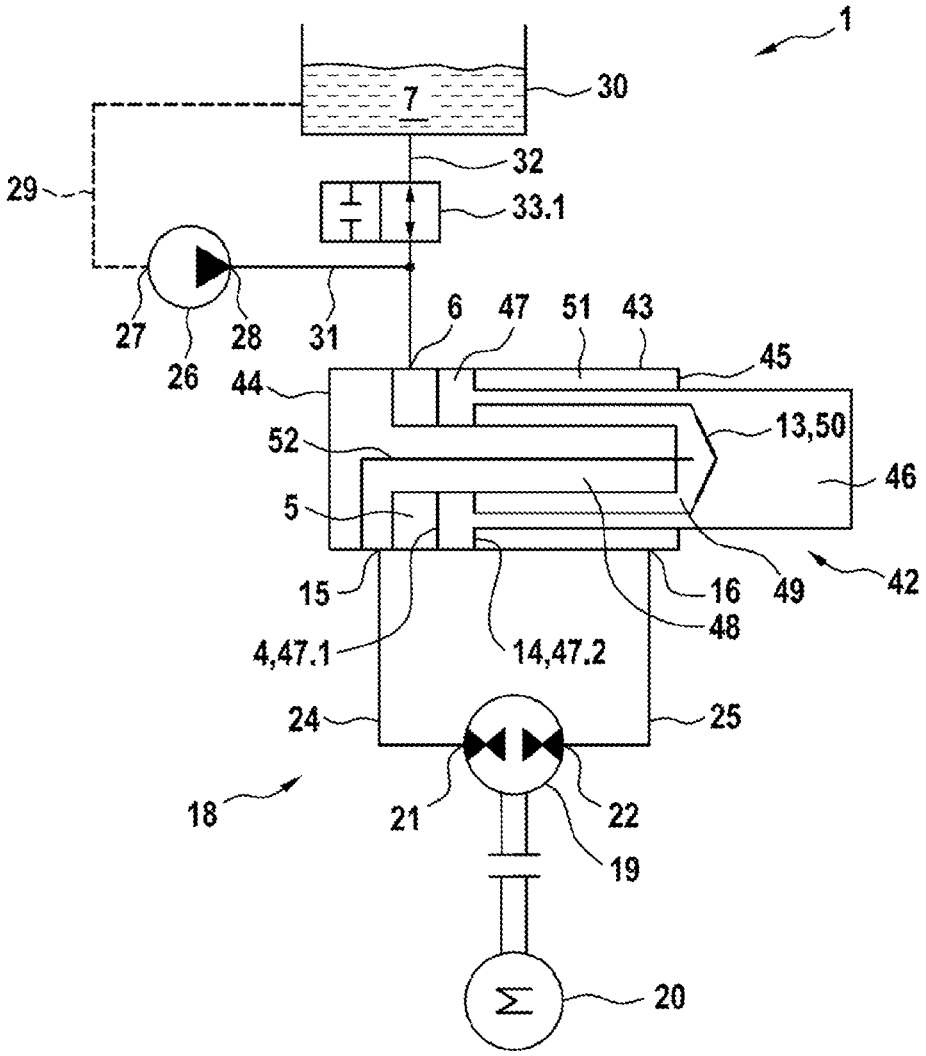
FIG. 3 is a schematic diagram of the first embodiment of the hydrostatic linear drive system with a 3-face cylinder.

FIG. 3 shows a third embodiment of a hydrostatic linear drive system 1 having a 3-face cylinder 42, which integrates the functions of the single-action cylinder 2 and the synchronous cylinder 9 of the embodiments according to FIGS. 1 and 2 in a sub-assembly. Components of the 3-face cylinder 42 which correspond in terms of function to the embodiments according to FIGS. 1 and 2 are given corresponding reference numerals. The 3-face cylinder 42 has a cylinder pipe 43, a cylinder base 44 which terminates the cylinder pipe 43 at an end side and a piston rod guide 45 which is arranged at the opposite end side. The piston rod guide 45 guides a piston rod 46 in an axial direction. An annular piston 47 is arranged at one end of the piston rod 46. From the cylinder base 44, a guiding pin 48 extends into the cylinder pipe 43. The annular piston 47 surrounds the guiding pin 48 and is moved in a sliding manner along the guiding pin 48 in an extension direction 8 (see FIGS. 3A and 3B) and a retraction direction 17 (see FIG. 3D).

The piston rod 46 has a hollow space 49 in the form of a blind hole which extends from the central passage in the annular piston 47 into the piston rod 46 and which surrounds the guiding pin 48.

The 3-face cylinder has first, second, and third hydraulically active faces 4, 13, 14. The first hydraulically active face 4 is formed by the first annular piston face 47.1 facing the cylinder base 44 and delimits a first annular cylinder chamber 5. The second hydraulically active face 13 is formed by a partial surface 50 of the hollow space 49, which is opposite the end side of the guiding pin 48. The third hydraulically active face 14 is formed by the second annular piston face 47.2 facing the piston rod guide 45.

A second annular cylinder chamber 51 is formed by the annular piston face 47.2, the cover (outer surface) of the piston rod 46, the inner face of the cylinder pipe 43 and at the end side by the piston rod guide 45.

The second and third hydraulically active faces 13, 14 correspond to each other in terms of size/area.

The first cylinder chamber 5 has a first fluid connection 6, through which the first hydraulically active face 4 can be acted on with a hydraulic fluid 7 in the extension direction 8 of the 3-face cylinder 42.

The second hydraulically active face 13 can be acted on with the hydraulic fluid 7 through a second fluid connection 15 in the extension direction 8. The second fluid connection 15 is located on the cylinder base 44. From the second fluid connection 15, the hydraulic fluid 7 reaches a discharge opening arranged at the end side of the guiding pin 48 through a fluid channel 52.

The third hydraulically active face 14 can be acted on with the hydraulic fluid 7 through the third fluid connection 16 in a retraction direction 17. The third fluid connection 16 opens in the second annular cylinder chamber 51.

The first hydraulically active face 4 can be acted on with the hydraulic fluid 7 in the extension direction 8 through the first fluid connection 6.

The second hydraulically active face 13 can be acted on with the hydraulic fluid 7 in the extension direction 8 through the second fluid connection 15.

The third hydraulically active face 14 can be acted on with hydraulic fluid 7 in the retraction direction 17 Via the third fluid connection 16.

A closed hydraulic circuit 18 which is under a pretensioning pressure comprises the first hydraulic pump 19, wherein the first pressure connection 21 is connected to the second fluid connection 15 via the hydraulic line 24 and the second pressure connection 22 is connected via the hydraulic line 25 to the third fluid connection 16 in a fluid-conducting manner.

An electric motor 20 drives the first hydraulic pump 19 at a constant or variable motor speed. The hydraulic pump 19 is preferably an axial piston variable-displacement pump of the swash plate construction type. As a result of the adjustment of the swash plate, the volume flow of the first hydraulic pump can be steplessly changed and reversed.

The pretensioning of the hydraulic fluid in the closed hydraulic circuit 18 may, for example, be produced by a pressure container which is not illustrated and which is connected to the pressure connections 21, 22 or by an external hydraulic pump.

In order to act on the first hydraulically active face 4 of the 3-face cylinder 42 with hydraulic fluid 7, a second hydraulic pump 26 with a low-pressure connection 27 and a high-pressure connection 28 is provided. The low-pressure connection 27 is connected to an equalizing tank 30 in a fluid-conducting manner by a hydraulic line 29 and the high-pressure connection 28 is connected in a fluid-conducting manner to the first fluid connection 6 by a hydraulic line 31.

The equalizing tank 30 which is open towards the environment receives hydraulic fluid 7 and is further connected in a fluid-conducting manner to the first fluid connection 6 of the 3-face cylinder 42 by a hydraulic line 32. In the hydraulic line 32 between the equalizing tank 30 and the first fluid connection 6, a 2/2-way valve 33.1 is arranged. When the linear drive system 1 is extended in rapid mode, the second hydraulically active face 13 is acted on with hydraulic fluid 7 through the second fluid connection 15 by the first hydraulic pump 19 which operates in the flow direction 23.1 according to FIG. 3A, whereby the annular piston 47 with the piston rod 46 moves in an extension direction 8. The hydraulically active face 4 is not acted on with hydraulic fluid 7 in rapid mode. The hydraulic fluid 7 from the equalizing tank 30 reaches the first cylinder chamber 5 of the 3-face cylinder 42 through the open 2/2-way valve 33.1 through the first fluid connection 6 (extraction). The second hydraulic pump 26 which is also connected to the first fluid connection 6 is not active.

Figure 3B:
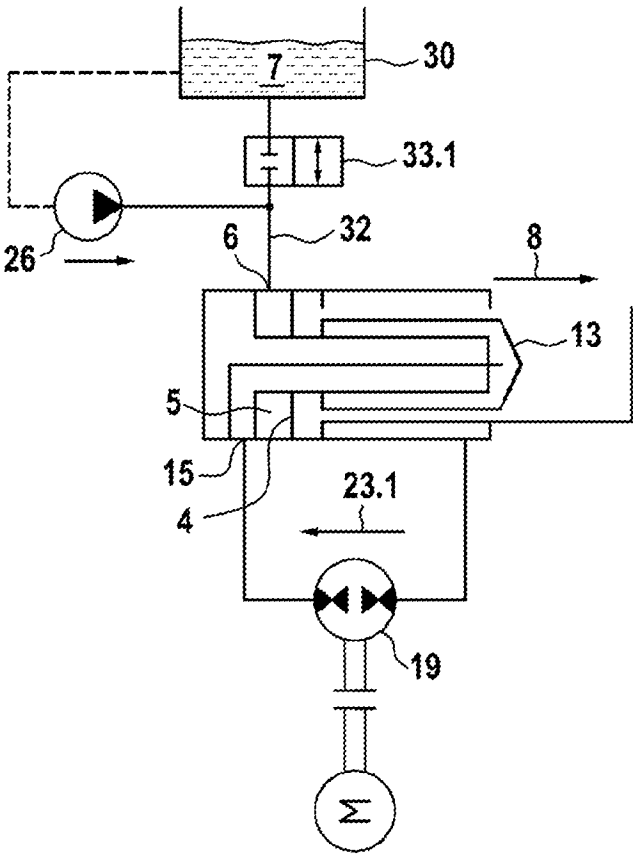
FIG. 3B is a schematic diagram of the system of FIG. 3 during the extension in the power mode.
Figure 3A:
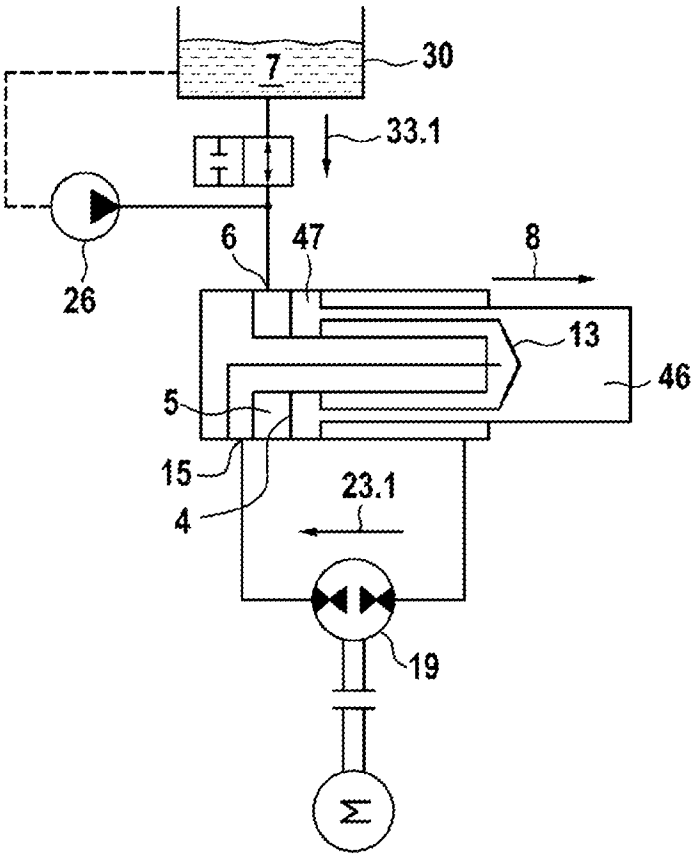
FIG. 3A is a schematic diagram of the system of FIG. 3 during the extension in the rapid mode.
Figure 3D:
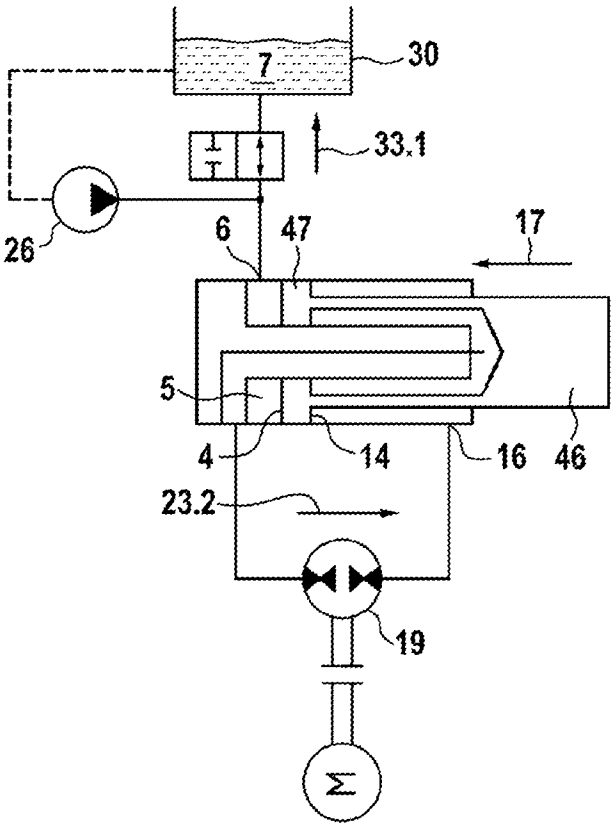
FIG. 3D is a schematic diagram of the system of FIG. 3 during the retraction in the rapid mode.

When the linear drive system 1 is retracted in rapid mode, the third hydraulically active face 14 is acted on with hydraulic fluid 7 through the third fluid connection 16 by the first hydraulic pump 19 which now operates in the opposite flow direction 23.2 according to FIG. 3D, whereby the annular piston 47 moves with the piston rod 46 in the retraction direction 17. The hydraulically active face 4 is not acted on with hydraulic fluid 7. The hydraulic fluid 7 is displaced through the open 2/2-way valve 33.1 from the cylinder chamber 5 of the first cylinder chamber 5 into the equalizing tank 30. The second hydraulic pump 26 which is connected to the first fluid connection 6 is not active.

When the linear drive system 1 is extended in power mode, the first hydraulically active face 4 of the 3-face cylinder 42 is acted on with hydraulic fluid 7 through the first fluid connection 6 by the activated second hydraulic pump 26, whereby the 3-face cylinder 42 moves in the extension direction 8 as shown in FIG. 3B. When extending in power mode, the first hydraulic pump 19 is further activated in the flow direction 23.1 so that, through the second fluid connection 15, the second hydraulically active face 13 is acted on with hydraulic fluid 7. A flow of the hydraulic fluid 7 from the first cylinder chamber 5 via the hydraulic line 32 into the equalizing tank 30 is prevented by the closed 2/2-way valve 33.1. The force produced during extension in power mode is produced by the cooperation of the larger first hydraulically active face 4 and the smaller second hydraulically active face 13.

Figure 3C:
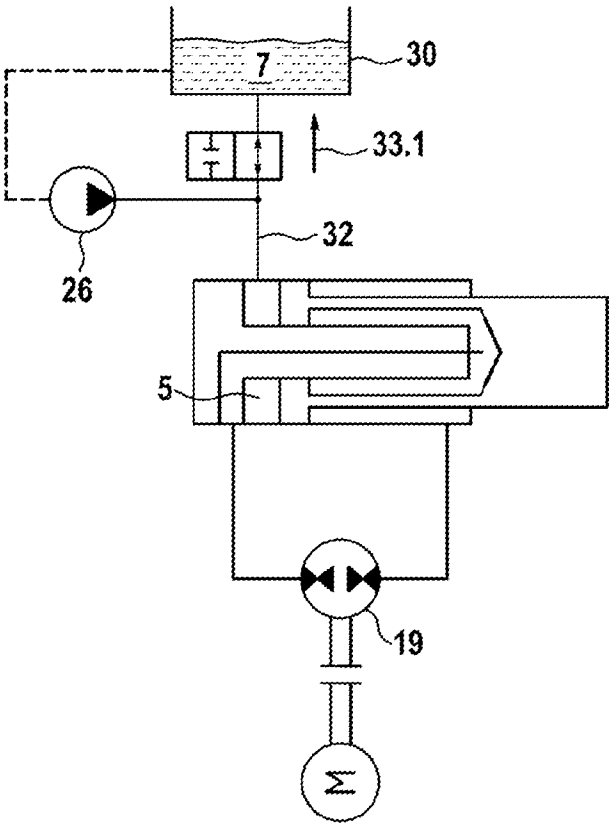
FIG. 3C is a schematic diagram of the system of FIG. 3 during cancellation of the force.

In order to end the power mode, the first hydraulic pump 19 and the second hydraulic pump 26 are deactivated and the 2/2-way valve 33.1 is opened as shown in FIG. 3C so that the hydraulic fluid 7 can flow from the first cylinder chamber 5 via the open 2/2-way valve 33.1 in the hydraulic line 32 into the equalizing tank 30.

Figure 4:
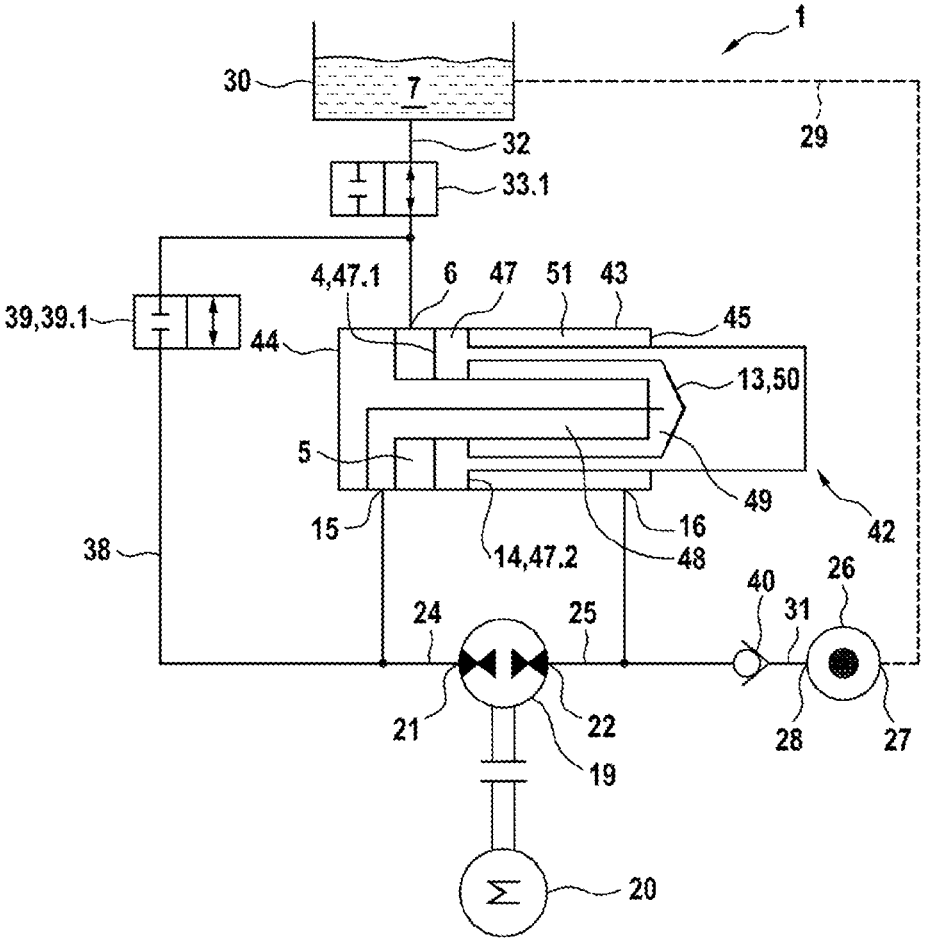
FIG. 4 is a schematic diagram of the second embodiment of the hydrostatic linear drive system having a 3-face cylinder.

FIG. 4 shows a fourth embodiment of a hydrostatic linear drive system 1 with a 3-face cylinder 42 which integrates the functions of the single-action cylinder 2 and the synchronous cylinder 9 of the embodiments according to FIGS. 1 and 2 in a sub-assembly. The 3-face cylinder 42 is constructed in accordance with the 3-face cylinder 42 of the third embodiment so that, in order to prevent repetition, reference may be made to the explanations of FIG. 3.

The fourth embodiment is different from the third embodiment with regard to the hydraulic supply of the 3-face cylinder 42 and will be explained in greater detail below. The differences correspond to the differences of the second embodiment compared with the first embodiment.

In order to act on the first hydraulically active face 4 with hydraulic fluid 7, the first fluid connection 6 of the 3-face cylinder 42 is connected via a hydraulic line 38 in a fluid-conducting manner to the first pressure connection 21 of the first hydraulic pump 19. In the hydraulic line 38, there is arranged a second shut-off member 39 which is constructed as a 2/2-way valve 39.1. A high-pressure connection 28 of a second hydraulic pump 26 is connected via a hydraulic line 31 in a fluid-conducting manner to the second pressure connection 22 of the first hydraulic pump 19. A non-return valve 40 in the hydraulic line 31 prevents a return flow of the hydraulic fluid 7 in the direction of the second hydraulic pump 26.

The low-pressure connection 27 of the second hydraulic pump 26 is connected to the equalizing tank 30 in a fluid-conducting manner via the hydraulic line 29. In contrast to the embodiment according to FIG. 3, however, the high-pressure connection 28 of the second hydraulic pump 26 is not directly connected in a fluid-conducting manner to the first fluid connection 6 of the 3-face cylinder 42, but instead indirectly via the flow path which has been released by the open 2/2-way valve 39.1 and the first hydraulic pump 19 which is activated in the flow direction 23.1.

The equalizing tank 30 which is open in the direction towards the environment receives hydraulic fluid 7 and is connected in a fluid-conducting manner to the first fluid connection 6 of the 3-face cylinder 42 by a hydraulic line 32. A 2/2-way valve 33.1 is arranged in the hydraulic line 32.

Figure 4B:
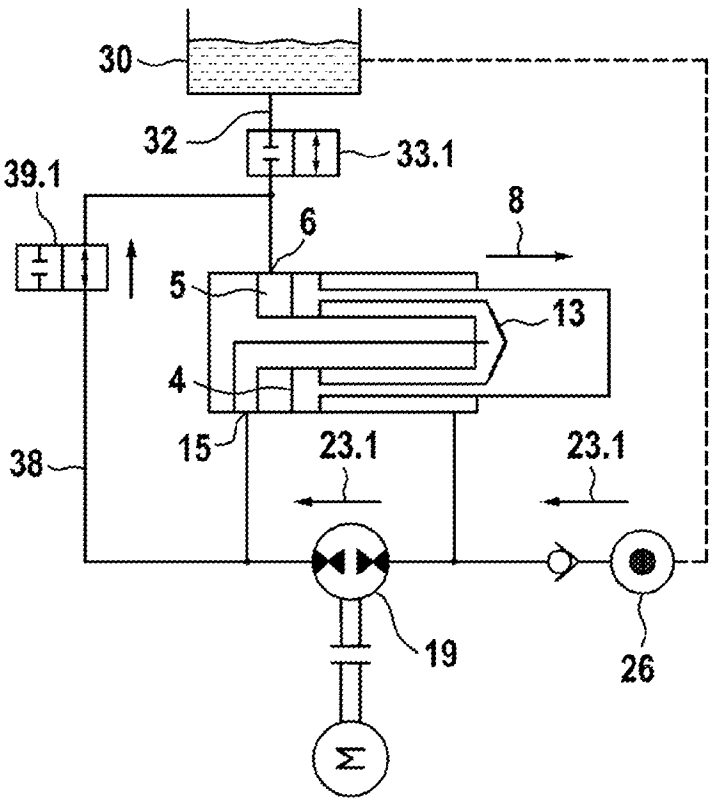
FIG. 4B is a schematic diagram of the system of FIG. 4 during the extension in the power mode.
Figure 4A:
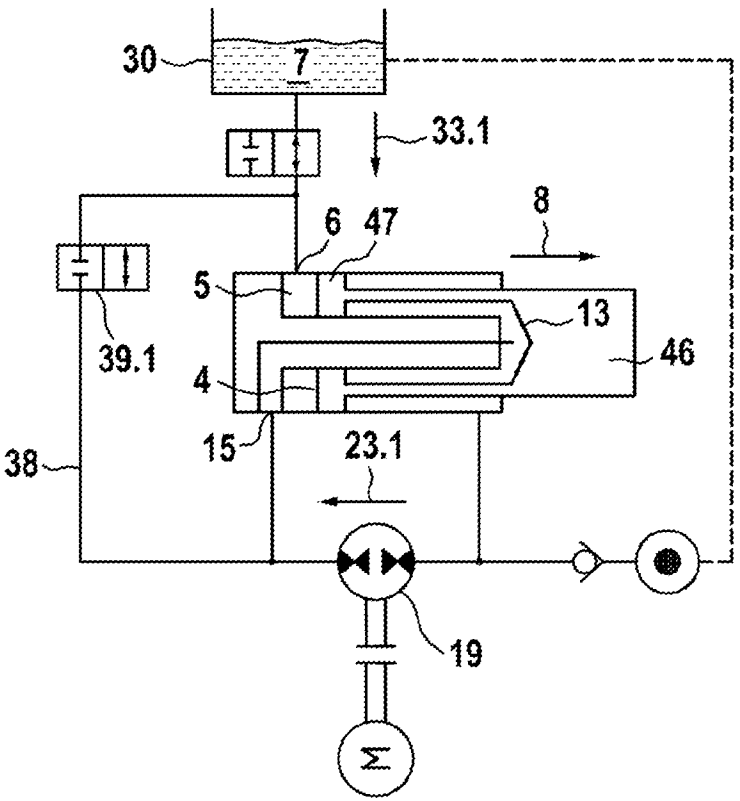
FIG. 4A is a schematic diagram of the system of FIG. 4 during the extension in the rapid mode.

When the linear drive system 1 is extended in rapid mode, the second hydraulically active face 13 is acted on with hydraulic fluid 7 via the second fluid connection 15 by the first hydraulic pump 19 which functions in the flow direction 23.1 as shown in FIG. 4A, whereby the annular piston 47 moves with the piston rod 46 in the extension direction 8.

The hydraulic fluid 7 from the equalizing tank 30 reaches the cylinder chamber 5 of the 3-face cylinder 42 through the open 2/2-way valve 33.1 via the first fluid connection 6 (extraction). The first hydraulically active face 4 is not acted on since the 2/2-way valve 39.1 in the hydraulic line 38 is closed.

Figure 4D:
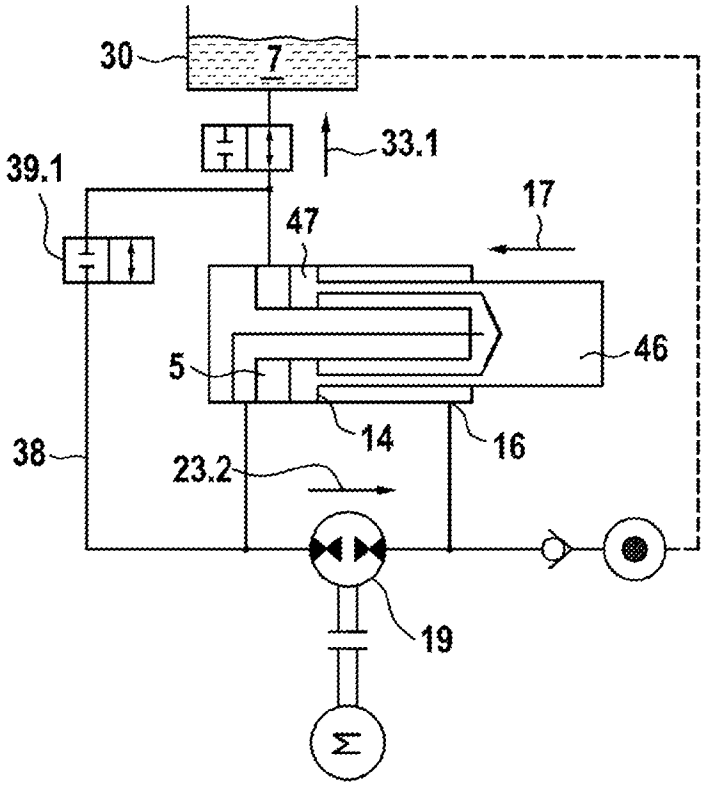
FIG. 4D is a schematic diagram of the system of FIG. 4 during the retraction in the rapid mode.

When the linear drive system 1 is retracted in rapid mode, the third hydraulically active face 14 is acted on with hydraulic fluid 7 through the third fluid connection 16 by the first hydraulic pump 19 which is now operating in the opposite flow direction 23.2 as shown in FIG. 4D, whereby the annular piston 47 together with the piston rod 46 moves in the retraction direction 17. The hydraulic fluid 7 is displaced through the open 2/2-way valve 33.1 from the cylinder chamber 5 of the 3-face cylinder 42 into the equalizing tank 30. The 2/2-way valve 39.1 in the hydraulic line 38 is closed.

When the linear drive system 1 is extended in power mode, the first hydraulically active face 4 is acted on with hydraulic fluid 7 via the first fluid connection 6 as shown in FIG. 4B, whereby the 3-face cylinder 42 moves in the extension direction 8. The 2/2-way valve 39.1 in the hydraulic line 38 is now open. Both the first hydraulic pump 19 and the second hydraulic pump 26 are activated and convey the hydraulic fluid 7 in a corresponding flow direction 23.1 in the direction of the first fluid connection 6. The activated second hydraulic pump 26 provides the required additional volume of hydraulic fluid 7 from the equalizing tank 30 in order to act with hydraulic fluid 7 on the first hydraulically active face 4 of the 3-face cylinder 42 via the first fluid connection 6 and to act with the hydraulic fluid on the second hydraulically active face 13 via the second fluid connection 15. A flow of the hydraulic fluid 7 via the hydraulic line 32 into the equalizing tank 30 is prevented by the closed 2/2-way valve 33.1.

Figure 4C:
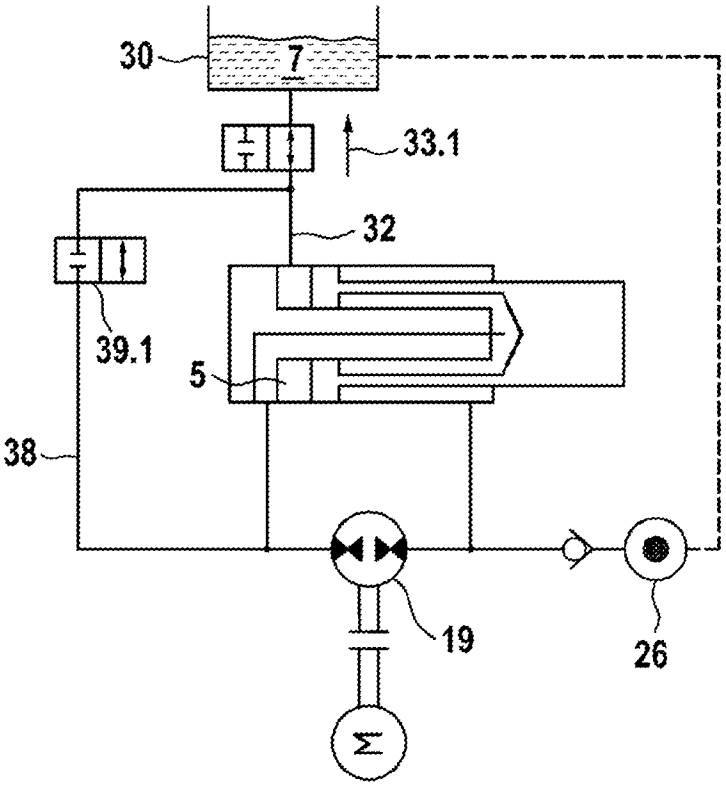
FIG. 4C is a schematic diagram of the system of FIG. 4 during cancellation of the force.

In order to end the power mode, the first hydraulic pump 19 and the second hydraulic pump 26 are deactivated, the 2/2-way valve 33.1 is opened and the 2/2-way valve 39.1 in the hydraulic line 38 is closed as shown in FIG. 4C so that the hydraulic fluid 7 flows from the first cylinder chamber 5 via the open 2/2-way valve 33.1 in the hydraulic line 32 into the equalizing tank 30.

Thus, while there has been shown and described and pointed out the fundamental novel features of the invention is applied to a preferred embodiment thereof, it will be understood that various omissions and substitutions and changes in the form and details of the devices illustrated, and in their operation, may be made by those skilled in the art without departing from the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

LIST OF REFERENCE NUMERALS

1 Linear drive system
2 Single-action cylinder
3 Piston rod of single-action cylinder
4 First hydraulically active face
5 First cylinder chamber
6 First fluid connection
7 Hydraulic fluid
8 Extension direction
9 Synchronous cylinder
10 Piston
11 Piston rod synchronous cylinder
12 Piston rod synchronous cylinder
13 Second hydraulically active face
14 Third hydraulically active face
15 Second fluid connection
16 Third fluid connection
17 Retraction direction
18 Closed hydraulic circuit
19 First hydraulic pump
20 Electric motor
21 First pressure connection
22 Second pressure connection
23.1 Flow direction
23.2 Opposite flow direction
24 Hydraulic line
25 Hydraulic line
26 Second hydraulic pump
27 Low-pressure connection
28 High-pressure connection
29 Hydraulic line
30 Equalizing tank
31 Hydraulic line
32 Hydraulic line
33 First shut-off member
33.1 2/2-way valve
34 Coupling member
35 Second cylinder chamber
36 Third cylinder chamber
38 Hydraulic line
39 Second shut-off member
39.1 2/2-way valve
40 Non-return valve
42 3-face cylinder
43 Cylinder pipe
44 Cylinder base
45 Piston rod guide
46 Piston rod
47 Annular piston
47.1 First piston face
47.2 Second piston face

48 Guiding pin
49 Hollow space
50 Partial surface
51 Second cylinder chamber
52 Fluid channel

What is claimed is:

1. A hydrostatic linear drive system, comprising:

a single-action cylinder having a cylinder component and a piston component with a first hydraulically active face;

a first fluid connection through which a hydraulic fluid can act on the first hydraulically active face in an extension direction of the single-action cylinder;

a synchronous cylinder having a cylinder component and a piston component with a second hydraulically active face and a third hydraulically active face, wherein an area of the second hydraulically active face corresponds to an area of the third hydraulically active face;

a second fluid connection and a third fluid connection, wherein the second hydraulically active face can be acted on with the hydraulic fluid through the second fluid connection in the extension direction and the third hydraulically active face can be acted on with the hydraulic fluid through the third fluid connection in a retraction direction counter to the extension direction, wherein an area of the first hydraulically active face of the single-action cylinder is greater than the area of the second hydraulically active face and the area of the third hydraulically active face of the synchronous cylinder;

a first hydraulic pump having a first pressure connection and a second pressure connection for providing a volume flow of the hydraulic fluid, wherein a flow direction of the volume flow between the pressure connections is reversible;

a closed hydraulic circuit under a pretensioning pressure including the synchronous cylinder and the first hydraulic pump, wherein the first pressure connection is connected to the second fluid connection and the second pressure connection is connected to the third fluid connection in a fluid-conducting manner, respectively;

an equalizing tank for the hydraulic fluid open towards the environment and a fluid-conducting connection between the equalizing tank and the first fluid connection of the single-action cylinder;

a first shut-off member in the fluid-conducting connection between the equalizing tank and the single-action cylinder, wherein the first shut-off member enables a throughflow of the hydraulic fluid into and out of the equalizing tank;

a second hydraulic pump having a low-pressure connection and a high-pressure connection configured for temporarily providing a volume flow of the hydraulic fluid, wherein the low-pressure connection is connected in a fluid-conducting manner to the equalizing tank and the high-pressure connection is connected in a fluid-conducting manner to the first fluid connection of the single-action cylinder; and a mechanical coupling connecting the piston component of the single-action cylinder to the piston component of the synchronous cylinder.

2. A hydrostatic linear drive system, comprising:

a cylinder having a cylinder pipe with a first end side and an opposing end side, a cylinder base arranged at and closing the first end side of the cylinder pipe, and a piston rod guide arranged at the opposing end side of the cylinder pipe, a guiding pin extending from the cylinder base into the cylinder pipe, an annular piston surrounding the guiding pin, the annular piston having a first annular piston face and a second annular piston face, and a piston rod having a hollow space surrounding the guiding pin and connected to the annular piston;

a first hydraulically active face formed by the first annular first piston face facing the cylinder base and delimiting a first cylinder chamber between the annular piston and the cylinder base;

a second hydraulically active face formed by a partial surface of the hollow space in the piston rod and which is opposite the end side of the guiding pin;

a third hydraulically active face formed by the annular second piston face facing the piston rod guide and delimiting a second cylinder chamber between the annular piston and the piston rod guide, wherein an area of the second hydraulically active face corresponds to an area of the third hydraulically active face;

a first fluid connection through which a hydraulic fluid can act on the first hydraulically active face in an extension direction of the cylinder;

a second fluid connection and a third fluid connection, wherein the second hydraulically active face can be acted on with the hydraulic fluid through the second fluid connection in the extension direction and the third hydraulically active face can be acted on with the hydraulic fluid through the third fluid connection in a retraction direction counter to the extension direction;

wherein an area of the first hydraulically active face is larger than the area of the second hydraulically active face and larger than the area of the third hydraulically active face;

a first hydraulic pump having a first pressure connection and a second pressure connection for providing a volume flow of the hydraulic fluid, wherein a flow direction of the volume flow between the pressure connections is reversible;

a closed hydraulic circuit under a pretensioning pressure and comprising the first hydraulic pump, wherein the first pressure connection is connected to the second fluid connection and the second pressure connection is connected to the third fluid connection in a fluid-conducting manner, respectively;

an equalizing tank for the hydraulic fluid open towards the environment and a fluid-conducting connection between the equalizing tank and the first fluid connection;

a first shut-off member in the fluid-conducting connection between the equalizing tank and the first fluid connection, wherein the first shut-off member enables a throughflow of the hydraulic fluid into and out of the equalizing tank; and a second hydraulic pump having a low-pressure connection and a high-pressure connection configured for temporarily providing a volume flow of the hydraulic fluid, wherein the low-pressure connection is connected in a fluid-conducting manner to the equalizing tank and the high-pressure connection is connected in a fluid-conducting manner to the first fluid connection.

3. The hydrostatic linear drive system according to claim 1, further comprising:

a fluid-conducting connection between the high-pressure connection of the second hydraulic pump and the second pressure connection of the first hydraulic pump;

a non-return valve in the fluid-conducting connection between the high pressure connection of the first hydraulic pump and the second pressure connection of the second hydraulic pump that prevents a return flow of the hydraulic fluid toward the second hydraulic pump; and a fluid-conducting connection between the first pressure connection and the first fluid connection; and a second shut-off member in the fluid-conducting connection between the first pressure connection and the first fluid connection.

4. The hydrostatic linear drive system according to claim 1, wherein at least one from the group of a displacement volume of the first hydraulic pump, a drive speed of the first hydraulic pump, a displacement volume of the second hydraulic pump, and a drive speed of the second hydraulic pump can be changed.

5. The hydrostatic linear drive system according to claim 1, wherein at least one from the group of the pressure connections of the first hydraulic pump and the high-pressure connection of the second hydraulic pump are connectable to a pressure store.

6. The hydrostatic linear drive system according to claim 1, wherein at least one from the group of the first shut-off member and the second shut-off member is a non-return valve.

7. The hydrostatic linear drive system according to claim 1, wherein the pretensioning pressure is higher than an ambient pressure.

8. The hydrostatic linear drive system according to claim 7, wherein the pretensioning pressure is between 5 and 50 bar.

9. The hydrostatic linear drive system according to claim 1, wherein a throttle is arranged in the fluid-conducting connection between the equalizing tank and the first fluid connection.

10. The hydrostatic linear drive system according to claim 1, wherein the single-action cylinder is a plunger cylinder.

11. The hydrostatic linear drive system according to claim 1, wherein the first hydraulic pump, the second hydraulic pump, and the first shut-off member are each controllable to be operated in a rapid mode in an extension direction and a retraction direction in which the first hydraulic pump is active, the first shut-off member is open, and the second hydraulic pump is inactive, and in a power mode in the extension direction in which both the first hydraulic pump and the second hydraulic pump are active and the first shut-off member is closed.

12. The hydrostatic linear drive system according to claim 2, further comprising:

a fluid-conducting connection between the high-pressure connection of the second hydraulic pump and the second pressure connection of the first hydraulic pump;

a non-return valve in the fluid-conducting connection between the high pressure connection of the first hydraulic pump and the second pressure connection of the second hydraulic pump that prevents a return flow of the hydraulic fluid toward the second hydraulic pump; and a fluid-conducting connection between the first pressure connection and the first fluid connection; and a second shut-off member in the fluid-conducting connection between the first pressure connection and the first fluid connection.

13. The hydrostatic linear drive system according to claim 2, wherein at least one from the group of a displacement volume of the first hydraulic pump, a drive speed of the first hydraulic pump, a displacement volume of the second hydraulic pump, and a drive speed of the second hydraulic pump can be changed.

14. The hydrostatic linear drive system according to claim 2, wherein at least one from the group of the pressure connections of the first hydraulic pump and the high-pressure connection of the second hydraulic pump are connectable to a pressure store.

15. The hydrostatic linear drive system according to claim 2, wherein at least one from the group of the first shut-off member and the second shut-off member is a non-return valve.

16. The hydrostatic linear drive system according to claim 2, wherein the pretensioning pressure is higher than an ambient pressure.

17. The hydrostatic linear drive system according to claim 16, wherein the pretensioning pressure is between 5 and 50 bar.

18. The hydrostatic linear drive system according to claim 2, wherein a throttle is arranged in the fluid-conducting connection between the equalizing tank and the first fluid connection.

19. The hydrostatic linear drive system according to claim 2, wherein the first hydraulic pump, the second hydraulic pump, and the first shut-off member are each controllable to be operated in a rapid mode in an extension direction and a retraction direction in which the first hydraulic pump is active, the first shut-off member is open, and the second hydraulic pump is inactive, and in a power mode in the extension direction in which both the first hydraulic pump and the second hydraulic pump are active and the first shut-off member is closed.

20. A hydrostatic linear drive system, comprising:

a cylinder including a piston component having a first hydraulically active face, a second hydraulically active face, and a third hydraulically active face, wherein an area of the second hydraulically active face corresponds to an area of the third hydraulically active face, and wherein an area of the first hydraulically active face is larger than the area of the second hydraulically active face and larger than the area of the third hydraulically active face;

a first fluid connection through which a hydraulic fluid can act on the first hydraulically active face in an extension direction of the piston component;

a second fluid connection and a third fluid connection, wherein the second hydraulically active face can be acted on with the hydraulic fluid through the second fluid connection in the extension direction and the third hydraulically active face can be acted on with the hydraulic fluid through the third fluid connection in a retraction direction counter to the extension direction;

a first hydraulic pump having a first pressure connection and a second pressure connection for providing a volume flow of the hydraulic fluid, wherein a flow direction of the volume flow between the pressure connections is reversible;

a closed hydraulic circuit under a pretensioning pressure including the first hydraulic pump, wherein the first pressure connection is connected to the second fluid connection and the second pressure connection is connected to the third fluid connection in a fluid-conducting manner, respectively;

an equalizing tank for the hydraulic fluid open towards the environment and a fluid-conducting connection between the equalizing tank and the first fluid connection;

a first shut-off member in the fluid-conducting connection between the equalizing tank and the first fluid connection, wherein the first shut-off member enables a throughflow of the hydraulic fluid into and out of the equalizing tank; and a second hydraulic pump having a low-pressure connection and a high-pressure connection configured for temporarily providing a volume flow of the hydraulic fluid, wherein the low-pressure connection is connected in a fluid-conducting manner to the equalizing tank and the high-pressure connection is connected in a fluid-conducting manner to the first fluid connection, wherein the piston component is configured so that:

the first hydraulically active face, the second hydraulically active face and the third hydraulically active face are arranged in a single cylinder, or the first hydraulically active face is arranged in a single-action cylinder and the second hydraulically active face and the third hydraulically active face are arranged in a synchronous cylinder separate from the single-action cylinder.

* * * * *